US005170503A

United States Patent [19]

Hightower, Jr. et al.

[11] Patent Number: 5,170,503

[45] Date of Patent: Dec. 15, 1992

[54] SNAKE PROTECTIVE LEGGINGS

[75] Inventors: George H. Hightower, Jr.; William R. Conine, III, both of Thomaston, Ga.

[73] Assignee: Thomaston Mills, Inc., Thomaston, Ga.

[21] Appl. No.: 680,404

[22] Filed: Apr. 4, 1991

[51] Int. Cl.[5] ..... A41D 17/02

[52] U.S. Cl. ..... 2/22; 2/242; 36/2 R

[58] Field of Search ..... 2/22, 242, 16, 24, 59, 2/61, 62, 240; 36/2 R

[56] References Cited

U.S. PATENT DOCUMENTS

| | | | |
|---|---|---|---|
| Re. 32,506 | 9/1987 | Hightower, Jr. | 2/22 |
| 361,360 | 4/1887 | Hunt . | |
| 1,708,144 | 4/1929 | Martin | 2/61 |
| 2,720,040 | 10/1955 | Rogers | 36/2 |
| 2,744,846 | 5/1956 | Stickles | 154/52.5 |
| 2,816,578 | 12/1957 | Frieder et al. | 139/409 |
| 3,153,864 | 10/1964 | Brewer | 36/3 |
| 3,191,185 | 6/1965 | Martin | 2/22 |
| 3,269,036 | 8/1966 | Parker et al. | 36/2 |
| 3,562,810 | 2/1971 | Davis | 2/2.5 |
| 3,758,963 | 9/1973 | Knight | 36/2 R |
| 3,902,196 | 9/1975 | Reinfandt | 2/2.5 |
| 4,057,853 | 11/1977 | McLane | 2/22 |
| 4,461,098 | 7/1984 | Diegelman | 2/61 |
| 4,503,566 | 3/1985 | Wheeler | 2/22 |
| 4,622,697 | 11/1986 | Tajima | 2/242 |
| 5,031,247 | 7/1991 | Carter | 2/22 |
| 5,033,126 | 7/1991 | Wruck et al. | 2/22 |

FOREIGN PATENT DOCUMENTS

| | | | |
|---|---|---|---|
| 811102 | 8/1951 | Fed. Rep. of Germany | 36/2 R |

*Primary Examiner*—Werner H. Schroeder
*Assistant Examiner*—Amy Brooke Vanatta
*Attorney, Agent, or Firm*—Kerkam, Stowell, Kondracki & Clarke

[57] ABSTRACT

A protective garment for shielding a wearer from snake bites upon the lower portion of the leg is disclosed. The garment is a legging made of woven fabric which will protect against snake bites even when the snake has fangs longer than the thickness of the material. The legging has two separate side edges extending all along its length and includes a strap, fabric fastener strips, and snap and socket fastener in order to provide adjustability, prevent gaps between the side edges, and minimize the risk that the fabric fasteners would become separated.

5 Claims, 1 Drawing Sheet

SNAKE PROTECTIVE LEGGINGS

BACKGROUND OF THE INVENTION

The present invention relates to a protective article of clothing and more particularly to leggings which are adapted to surround the lower portion of the legs of a wearer whereby they are protected from snake bites.

The use of protective leggings is well known. In particular, hunters, hikers, and other outdoorsmen have used various protective leggings to protect against snake bites when walking through heavy undergrowth areas.

U.S. Pat. No. 3,269,036, issued to Parker et al on Aug. 30, 1966, discloses a protective legging including a protective sheet made of aluminum or similar material.

U.S. Pat. No. 3,191,185, issued to Martin on Jun. 29, 1965, discloses a protective legging having two fabric concentric cylinders with a lining of lightweight plastic material such as styrofoam. The legging is disclosed as being preferentially of a thickness of about five-sixths of an inch. Although the fabric is penetrable by the fangs of a snake, the thickness of the plastic material layer prevents the fangs from reaching the inner fabric cylinder, thereby protecting the legs of the wearer.

U.S. Pat. No. 4,057,853 issued to McLane on Nov. 15, 1977, discloses a protective legging having a double layer of closely woven stainless steel mesh to protect the wearer against snake bites.

The Brewer U.S. Pat. No. 3,153,864 issued on Oct. 27, 1964 discloses a protective legging which is adjustable in size.

The Knight U.S. Pat. No. 3,758,963 issued on Sep. 18, 1973 discloses a snake protective device having hinged semi-cylindrical halves and made of aluminum, plastic, or the like.

Stickles U.S. Pat. No. 2,744,846 issued on May 8, 1956 and Davis U.S. Pat. No. 3,562,810 issued on Feb. 16, 1971, both disclosed the use of garments made of protective material in order to protect against bullets and similar projectiles.

Reinfandt U.S. Pat. No. 3,902,196 shows a fabric arrangement using ballistic nylon to protect against penetration from dog teeth.

U.S. Pat. No. 2,720,040 issued on Oct. 11, 1955 to Rogers relates to rain pants and discloses various connectors for connecting portions together including cloth strips on a belt to connect two complimentary snap fasteners.

The Hunt U.S. Pat. No. 361,360 issued on Apr. 19, 1887, and the Frieder U.S. Pat. No. 2,816,578 issued on Dec. 17, 1957 both disclose arrangements of woven fabric, the Frieder patent describing a ballistic cloth type of woven fabric.

West German Patent 811,102 issued on Aug. 16, 1951 discloses a legging arrangement using a zipper extending substantially along the length of the legging.

In addition to the above designs, at least two kinds of below knee or half leg (i.e., not full leg length) snake protective garments have been available. One kind uses a hard plastic cylinder having split side edges which overlap. Although it may protect against snake bites, its rigidity and other characteristics make it generally uncomfortable. Another type of these half leg snake leggings are made of canvas over a wire mesh and have separate side edges which overlap or come together with three buckle type fasteners spaced at different places along the length of the side edges. The wire mesh is generally heavy to wear and, although it is not rigid, it is generally stiff.

One of the present inventors previously patented a design for snake proof chaps under U.S. reissue Pat. No. 32,506 issued on Sep. 22, 1987 to Hightower and hereby incorporated by reference. That protective garment included a full length (designed to cover most of a wearer's thighs) generally tubular portion for enclosing a wearer's legs. Use of a special woven fabric provided protection against snake fangs while allowing the garment to be relatively flexible and thereby providing the wearer with more comfort than typical for other snake protective leggings. Accordingly, the snake chaps of that patent have enjoyed considerable commercial success over quite a few years now. During various demonstrations of those chaps, some of the inventors of the present application have had live poisonous snakes, such as diamondback rattlesnakes, lunge at them hundreds of times and possibly as many as 2,000 times. This experience has shown that most of the time snakes will lunge at the lower part of a wearer's leg.

The snake chaps according to the previous Hightower patent worked quite well at safeguarding wearers from these type of attacks. However, they may provide more protection than is needed in certain circumstances. For example, if one is going to go hunting or hiking in an area where the poisonous snakes are likely to be relatively small in length, the Hightower design of snake chaps is protecting the upper leg of the wearer when such protection is unlikely to be needed. Under those circumstances, that design of snake chaps may be improved upon to provide protection at necessary parts of the wearer, while at the same time maximizing the comfort to the wearer and minimizing the weight of the protective legging.

OBJECTS AND SUMMARY OF THE INVENTION

Accordingly, it is a primary object of the present invention to provide a new and improved snake protective legging.

A further object of the present invention is to provide a snake protective legging which provides protection where it is most needed and which is as lightweight as possible in order to maximize comfort to the wearer.

Yet another object of the present invention is to provide a snake protective legging which may be easily put on one's leg and is well sealed to prevent gaps in protection which might allow a snake to penetrate to underneath the snake protective legging.

A still further object of the present invention is to provide a snake protective legging which is conveniently secured to the wearer's leg.

Yet another object of the present invention is to provide a snake protective legging which allows for a variable amount of overlap between side edges so as to accommodate different sized wearers, while at the same time providing a positive engagement between side edges such that side edges will not be separated by getting part of the legging stuck on a bush.

The above and other objects of the present invention which will become more apparent as the description proceeds are realized by a protective article of clothing adapted to prevent snake fangs from biting into the lower leg of a wearer. The article includes a generally tubular leg enclosing portion made of a woven fabric of nylon resistant to snake bites. The leg enclosing portion has a length and two opposite side edges separable along the length. The leg enclosing portion has an upper part and a lower part. A fastener is provided for connecting the two side edges. A securing means is attached to the upper part for holding the leg enclosing portion up on a wearer's leg. The leg enclosing portion includes nylon fiber in the form of continuous filament yarn. The leg enclosing portion prevents penetration by snake fangs even when the snake fangs are longer than the thickness of the leg enclosing portion. The leg enclosing portion has an upper edge and a lower edge separated by a length corresponding to below the knee protection. Preferably, the length would be no more than two feet. The securing means is adjustable to allow a variable amount of overlap of the side edges. The fastener includes mating fabric fastener strips extending lengthwise along each of the side edges. One of the fastener strips is a fabric hook fastener strip and the other of the fastener strips is a fabric loop fastener strip. A fixed fastener means having mating parts disposed on opposite ones of the side edges and adjacent the lower edge provide a fixed amount of overlap between the side edges adjacent the fixed fastener means when the mating parts are fastened together. The mating parts preferably comprise a snap and a socket. The securing piece is preferably a strap attached at one side edge and connecting to a buckle mounted at the opposite side edge. The woven fabric weights between 8.0 and 12.0 ounces per square yard. The woven fabric is made of threads between 900 and 1,100 denier. The inside of the woven fabric has a coating of synthetic rubber polymer of between 1 and 2 ounces per square yard. The leg enclosing portion is preferably a basket weave fabric. The fastener strips are disposed between the securing piece and the fixed fastener means. The leg enclosing portion is less than ¼ inch, and more preferably less than ⅛ inch, in thickness throughout substantially all of its area (i.e., meaning over 90% or more of its area). The leg enclosing portion includes a plurality of layers of the woven fabric.

BRIEF DESCRIPTION OF THE DRAWINGS

These and other features of the present invention and the advantages thereof will be readily apparent when the following detailed description is considered in conjunction with the accompanying drawings wherein like characters represent like parts throughout the several views and in which.

DETAILED DESCRIPTION

Figure 2:
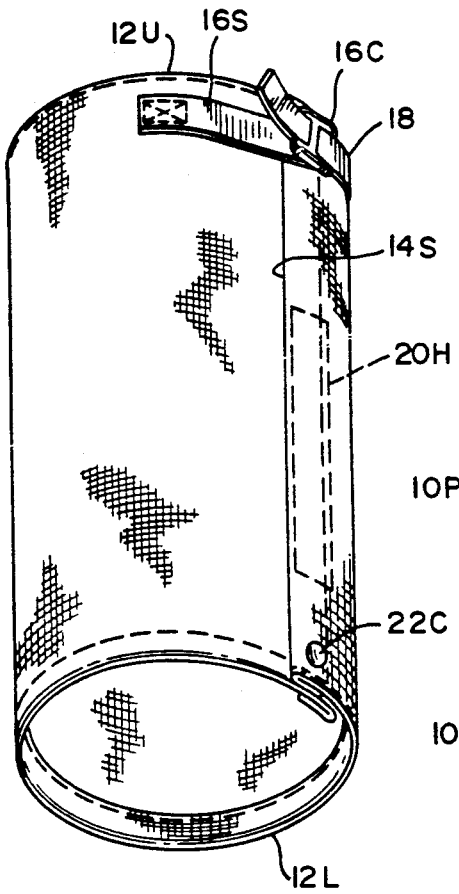
FIG. 2 shows a prospective view of the present invention with the side edges brought together.
Figure 1:
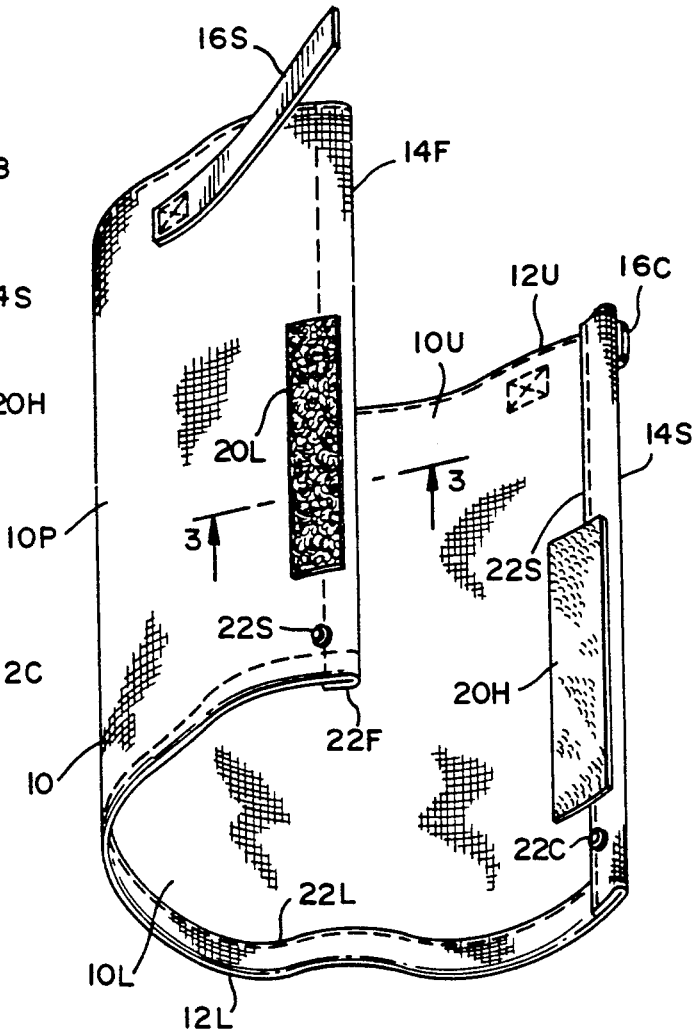
FIG. 1 shows a prospective view of the present invention with the side edges separated.

With reference now to FIGS. 1 and 2, the legging 10 includes a leg enclosing portion 10P with a lower part 10L bounded by lower edge 12L and an upper part 10U bounded by upper edge 12U. As shown, the leg enclosing portion 10P is generally tubular and made of woven fabric. The edges 12L and 12U are separated by a length corresponding to below the knee (half leg) protection. Preferably, this length is less than 2 feet and it is 16½ inches in the preferred embodiment. The article 10 has first and second side edges 14F and 14S which allow a wearer to put his or her leg within the generally tubular portion. A strap 16S is sewn to the upper part 10U adjacent side edge 14F and serves as a securing means to hold the leg enclosing portion up on a wearer's leg by attachment to a cinch 16C attached to a relatively short length of strap 18 (FIG. 2 only) which is sewn to the upper part 10U adjacent the edge 14S. A loop (not shown) of the short strap 18 may secure a part of the cinch 16C to the strap 18 in known fashion. The strap 16S can be attached to the cinch 16C by known techniques such that the overlap between the edges when the legging is closed (FIG. 2 position) is variable. Mating strips 20L and 20H are disposed respectively adjacent edge 14F on the outside of the article 10 and adjacent edge 14S on the inside. Fastener strip 20L is preferably fabric loop fasteners, whereas fastener strip 20H is a fabric hook fastener. These fasteners are commonly sold under the trademark VELCRO. Referring momentarily to the cross section view of FIG. 3, it will be seen that fastener strip 20L is sewn to the layers of woven fabric which comprise the article. Although not shown, the fastener strip 20H would likewise be sewn around its edges to the layers of fabric. Referring back to FIGS. 1 and 2, a snap 22S and socket 22C serve as mating parts and collectively are a fixed fastener means which provide a fixed amount of overlap between the side edges adjacent thereto when the parts are fastened together. In other words, when the snap 22S is snapped into the socket 22C, there will be a fixed amount of overlap of side edge 14S relative to side edge 14F.

The strap 16S and cinch 16C allow one to adjust the legging to hold it up on the wearer's leg and provide variable overlap of the side edges for that purpose. The fastener strips 20L and 20H extend lengthwise along the length of the article 10 (i.e., parallel to edges 14F and 14S and the not shown central axis of the generally cylindrical portion 10P). Accordingly, the strips 20L and 20H prevent any significant gap from developing which might allow a snake to get its fangs past the protective woven fabric. However, the fabric fastener strips might at least partially separate upon a part of the legging catching a bush or other obstacle. To minimize that risk, the snap 22S and socket 22C are provided. Since the snap and socket must be pulled almost directly normal to the plane in which they are disposed to allow separation, an accidental separation is much less likely than with the fabric fasteners where a partially normal force may cause some separation. Although the snap 22S provides a fixed amount of overlap of the edges adjacent to the snap, the fabric fasteners 20L and 20H are made sufficiently wide (preferably about two inches) such that the fabric fasteners will make at least some contact throughout a wide range over which the strap 20S may be adjusted. As best shown in FIG. 1, the strap 16S is vertically separated from the fabric strip 20L, which in turn is vertically separated from the snap 22S. In similar fashion, the cinch 16C and short strap 18 (FIG. 2 only) are vertically separated from the fabric fastener strip 20H, which is in turn vertically separated from the socket 22C. In other words, this connection arrangement provides the advantage of resistance to accidental separation and the advantage of adjustability based upon the variable overlap from the strap 16S. This arrangement also provides for a very quick fastening. The user may simply snap the snap 22S into socket 22C, adjust the strap 16S in the cinch 16C, and then press against the edge 14S so that the fabric fasteners 20L and 20H are joined together.

As shown in FIG. 1, the leg enclosing portion 10P includes doubled over portions 22F, 22S, and 22L which extend respectively along edges 14F, 14S, and 12L. These doubled over portions simply are areas where the plurality of layers making up the portion 10P have been doubled over and sewn back. Substantially all of the leg enclosing portion (i.e., meaning more than 90%) corresponding to the parts other than the doubled over portions are preferably less than ¼ inch in thickness and, in the preferred design, are less than ⅛ inch in thickness.

Figure 3:
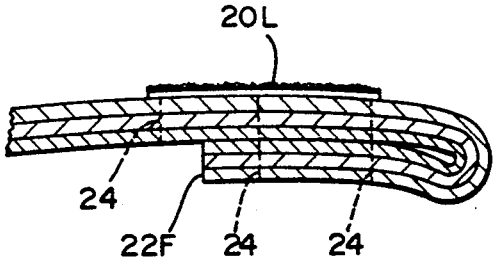
FIG. 3 shows a cross section view taken along lines 3—3 of FIG. 1.

With reference now to FIG. 3, it will be seen that most of the leg enclosing portion 10P constitutes a triple layer of woven fabric which is sewn together at sewing lines 24. Although not separately labeled, a similar sewing line is extending along the upper edge 12U of FIG. 1 and along the other doubled over portions.

Figure 4:
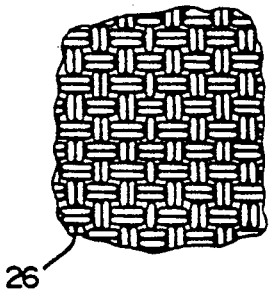
FIG. 4 shows the weave of the fabric of the present invention.

As shown in FIG. 4, the woven fabric 26 of the present invention is a basket weave and would be identical to the fabric of the incorporated by reference Hightower patent. More specifically, the fabric construction is a basket weave of nylon fiber in the form of continuous filament yarn and having 46 ends per inch (warp) by 42 ends per inch (filling) with two ends drawn as one (warp) and two picks per shed (filling). Preferably, the nylon fiber is nylon type 6,6 in the form of continuous filament yarn such as sold by DuPont under the trademark Cordura. The basket weave should be made of threads between 900 and 1,100 denier with 1,000 denier being the preferred value. The basket weave weighs between 8.0 and 12.0 ounces per square yard with 9.9 ounces per square yard being the preferred value.

In addition to the strength provided by the continuous filament of nylon fiber arranged in the basket weave configuration, the basket weave fabric would include on its inside (that side closest the wearer) a coating of synthetic rubber polymer. The coating is preferably a polyurethane coating upon each of the layers of fabric. In the preferred embodiment, the coating is polyurethane applied between 1 and 2 ounces per square yard with 1.5 ounces per square yard being the ideal. Although such a coating is quite thin, it is quite sufficient to render the woven fabric of the leg enclosing portion impervious to snake bites.

Although various materials and constructions for the present invention have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. A protective article of clothing adapted to prevent snake fangs from biting into the lower leg of a wearer, said protective article comprising:

a generally tubular leg enclosing portion made of a woven fabric of nylon resistant to snake bites, having a length and two opposite side edges separable along the length, and having an upper part and a lower part; and a fastener for connecting said two side edges; and said leg enclosing portion comprises nylon fiber in the form of continuous filament yarn, wherein said leg enclosing portion prevents penetration by snake fangs even when the snake fangs are longer than the thickness of the leg enclosing portion, and wherein said leg enclosing portion has an upper edge and a lower edge separated by a length corresponding to only below the knee protection, wherein said fastener comprises mating fabric fastener strips extending lengthwise along each of said side edges, and further comprising a snap and a socket disposed on opposite ones of said side edges adjacent said lower edge and further comprising a securing means attached to said upper part for holding the leg enclosing portion up on a wearer's leg, said securing means allowing a variable amount of overlap between the side edges adjacent said securing means and wherein said securing means is vertically separated from said mating fabric fastener strips and wherein said mating fabric fastener strips are vertically separated from said snap and said socket.

2. The article of claim 1 wherein said leg enclosing portion is less than ¼" in thickness throughout substantially all of its area.

3. The article of claim 1 wherein said woven fabric is made of threads between 900 and 1,100 denier.

4. The article of claim 1 wherein said leg enclosing portion comprises a plurality of layers of said woven fabric.

5. The article of claim 1 wherein said securing means comprises a strap attached at one side edge and further comprising a buckle mounted at an opposite side edge for receiving said strap, and wherein said two side edges are attached by operation of said strap and said buckle, said snap and said socket, and said mating fabric fastener strips only.

* * * * *